United States Patent [19]

Kurotori et al.

[11] Patent Number: 4,948,691

[45] Date of Patent: Aug. 14, 1990

[54] IMAGE FIXING METHOD FOR USE IN WET-TYPE ELECTROPHOTOGRAPHIC COPYING MACHINE

[75] Inventors: Tsuneo Kurotori, Tokyo; Namabu Mochizuki; Kenzo Ariyama, both of Yokohama, all of Japan

[73] Assignee: Ricoh Company, Ltd., Tokyo, Japan

[21] Appl. No.: 322,307

[22] Filed: Mar. 13, 1989

[30] Foreign Application Priority Data

Apr. 2, 1988 [JP] Japan ..... 63-82625

[51] Int. Cl.[5] ..... G03G 13/20

[52] U.S. Cl. ..... 430/99; 430/126; 430/114; 430/115

[58] Field of Search ..... 430/114, 115, 126, 99

[56] References Cited

U.S. PATENT DOCUMENTS 3,933,490 1/1976 Tsuchiya ..... 430/30

*Primary Examiner*—J. David Welsh

*Attorney, Agent, or Firm*—Oblon, Spivak, McClelland, Maier & Neustadt

[57] ABSTRACT

An image fixing method for use in a wet-type electrophotographic copying machine is disclosed, which comprises the steps of: (1) developing a latent electrostatic image formed on an electrophotographic photoconductor element to a visible toner image by use of a developer comprising a thermal cross-linking toner and a carrier liquid, (2) transferring the visible toner image to a transfer sheet having an oil absorption coefficient $\alpha$ of $1.0\times10^{-2}$ cm/sec or more, which is assessed by dividing the thickness of the transfer sheet by the time required for a drop of the carrier liquid placed on the front side of the transfer sheet to spread to a diameter of 1 cm on the back side of the transfer sheet, to form a transferred image on the transfer sheet, and (3) fixing the transferred image to the transfer sheet by bringing a heat application means into direct contact with the transferred image.

8 Claims, 2 Drawing Sheets

IMAGE FIXING METHOD FOR USE IN WET-TYPE ELECTROPHOTOGRAPHIC COPYING MACHINE

BACKGROUND OF THE INVENTION

1. Field of the Invention

The present invention relates to an image fixing method for use in a wet-type electrophotographic copying machine, more particularly to an image fixing method comprising the steps of developing a latent electrostatic image to a visible toner image by use of a developer comprising a thermal cross-linking toner and a carrier liquid, transferring the visible toner image to a transfer sheet, and fixing the transferred toner image to the transfer sheet by bringing a heat application means into direct contact with the transferred image.

2. Background of the Related Art

In a wet-type electrophotographic copying machine, there is conventionally known an image fixing method comprising the steps of developing an electrostatic latent image formed on a photoconductive member to a visible toner image with a liquid-type developer, transferring the visible toner image to a transfer sheet, and fixing the transferred image to the transfer sheet by bringing a heat application means into contact with the opposite side of the transfer sheet to the toner-image-bearing side thereof.

Such a conventional image fixing method can be explained with reference to a wet-type electrophotographic copying machine as shown in FIG. 3. In this wet-type electrophotographic copying machine, a heat-application roller 21 with a heater 23 incorporated therein and a plurality of pressure-application rollers 22 are provided. By the pressure-application rollers 22 which are in contact with the toner-image bearing side of a transfer sheet P, the transfer sheet P is brought into pressure contact with the heat application roller 21. More specifically, the heat-application roller 21 with the heater 23 incorporated therein is disposed along a paper path through which the unfixed toner image bearing transfer sheet P advances in the direction of the arrow, with its back side in close contact with the heat application roller 21. On the opposite side across the paper path, a plurality of the pressure-application rollers 22 are located in order to allow the transfer sheet P to come into close contact with the heat-application roller 21. As previously mentioned, the unfixed toner image bearing transfer sheet P is heated by the heat-application roller 21 from the back side thereof. The reason for this is to prevent the unfixed toner image formed on the transfer sheet P from corrupting or flowing under the direct application of heat, because the unfixed toner image contains a considerable amount of a solvent component therein, so that the toner particles are not so tightly bonded to each other, thus the toner images are easily corrupted.

When the transferred toner image is fixed to the transfer sheet by bringing a heat application means into contact with the back side of the transfer sheet, the thermal energy supplied by the heat application means is applied to the back of the transfer sheet P to elevate the temperature thereof, and then transmitted to the unfixed toner image thereon. Therefore, the image quality of the fixed images is considerably affected by the thickness and the surface smoothness of the transfer sheet. If the thickness and the surface smoothness of the transfer sheet are not appropriate, satisfactory fixing performance may not be obtained. Furthermore, this fixing method has its limit in application in the case of high-speed copying.

Instead of the above-mentioned back-side heat application image fixing method, an image fixing method of bringing a heat application means into direct contact with the transferred image is proposed in Japanese Laid-Open Patent Application 62-139426, which is referred to as the front-side heat application image fixing method.

The mechanism of this front-side heat application image fixing method is illustrated in FIG. 4. As shown in FIG. 4, a heat-application roller 31 having an inner heater 33 therein is brought into pressure contact with a pressure-application roller 32, with the paper path of the transfer sheet P interposed therebetween. A cam surface of a pressure-application cam 35 is in pressure contact with a shaft portion of the pressure-application roller 32 by the urging force of a spring 36. Around the heat-application roller 31, a thermistor 37 and a fuse 38 are provided to control the temperature of the heat-application roller 31. A transfer sheet separating pawl 40 is situated in contact with the surface of the heat-application roller 31. A silicone oil application felt 41 is in contact with the surface of the roller 31. The transfer sheet separating pawl 40 and the silicone oil application felt 41 serve to prevent the transfer sheet from winding around the heat-application roller 31.

However, the above-mentioned direct heating method by which the surface of the unfixed toner image bearing transfer sheet is directly heated by the heat-application means has the shortcoming that the image quality of the fixed image varies depending on the kind or type of the transfer sheet P. In particular, when transfer sheets through which a liquid developer does not permeate, such as a transparent film for the overhead projector (OHP), an intermediate original sheet and art paper, are employed, the unfixed toner image on the transfer sheet is caused to disadvantageously corrupt or flow in the course of image fixing and accordingly the fixed image becomes illegible.

SUMMARY OF THE INVENTION

It is therefore an object of the present invention to provide an improved image fixing method of directly heating a toner image bearing side of a transfer sheet in a wet-type electrophotographic copying machine, from which the above-mentioned conventional shortcomings are eliminated, capable of yielding excellent images without any image corruption or flow.

The above object of the present invention can be achieved by an image fixing method comprising the steps of: (1) developing a latent electrostatic image formed on an electrophotographic photoconductor element to a visible toner image by use of a developer comprising a thermal cross-linking toner and a carrier liquid, (2) transferring the visible toner image to a transfer sheet having an oil absorption coefficient a of $1.0\times10^{-2}$ cm/sec or more, which is determined by dividing the thickness of the transfer sheet by the time required for a drop of the carrier liquid placed on the front side of the transfer sheet to spread to a diameter of 1 cm on the back side of the transfer sheet, to form a transferred toner image on the transfer sheet, and (3) fixing the transferred toner image to the transfer sheet by bringing a heat application means into direct contact with the transferred image.

DETAILED DESCRIPTION OF THE PREFERRED EMBODIMENTS

The thermal cross-linking toner for use in the present invention comprises a resin and a pigment and, when necessary, with addition of a polarity controlling agent thereto.

Specific examples of the resin for use in the thermal cross-linking toner are as follows:

1. A resin comprising 50 parts by weight of styrene, 40 parts by weight of methyl methacrylate and 10 parts by weight of divinylbenzene in weight ratio.
2. A resin comprising 60 parts by weight of styrene, 35 parts by weight of methyl acrylate and 5 parts by weight of divinylbenzene in weight ratio.
3. A resin comprising 75 parts by weight of styrene, 20 parts by weight of n-butyl acrylate and 5 parts by weight of divinylbenzene in weight ratio.

Specific examples of the pigment for use in the thermal cross-linking toner include commercially available carbon black pigments such as Mogul L made by Cabot Corporation; Printex V made by Degussa Inc.; Raven #40, Raven #30 and Raven #20 made by Columbia Carbon Ltd.; and Mitsubishi #44 made by Mitsubishi Carbon K.K.

Specific examples of the polarity controlling agent for use in the thermal cross-linking toner include lecithin, vinyl chloride, vinyl chloride—vinyl acetate copolymer and chlorinated rubber.

It is confirmed that a thermal cross-linking toner that can be employed in the present invention, disclosed in Japanese Laid-Open Patent Application No. 62-139426 by the same applicant of the present application, is cross-linked according to a test of its flow characteristics using a flow tester. Therefore a toner image formed by the thermal cross-linking toner on a transfer sheet can be maintained as it is without any image flow even though the heat or pressure is directly applied thereto.

Figure 2:
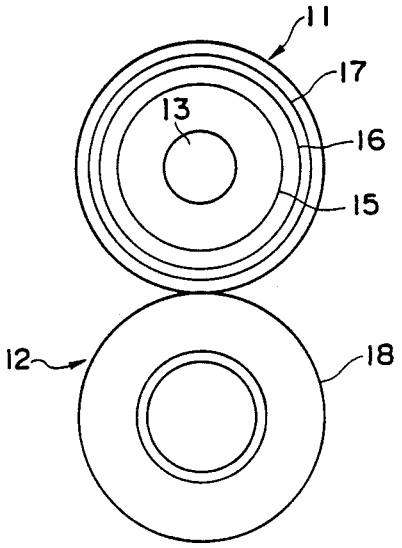
FIG. 2 is a schematic cross-sectional view of a heat-application roller and a pressure-application roller in an image fixing unit for use in the present invention.
Figure 3:
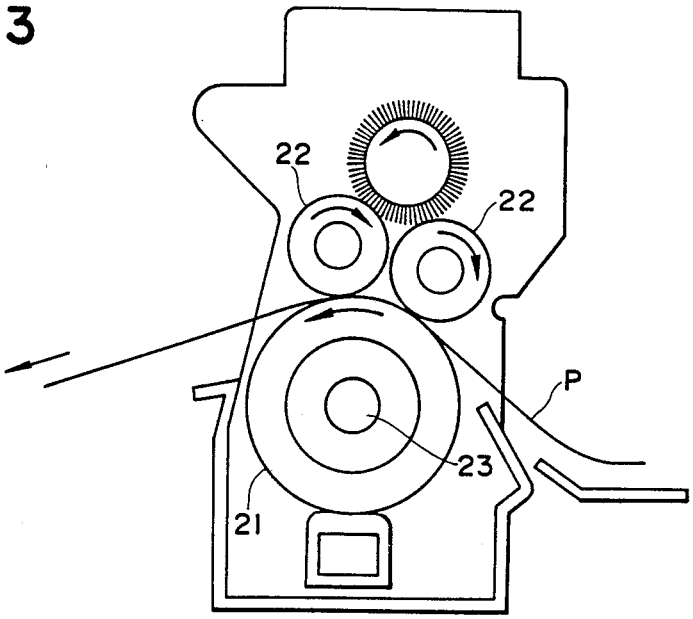
FIG. 3 is a schematic diagram of an example of a conventional image fixing unit.
Figure 4:
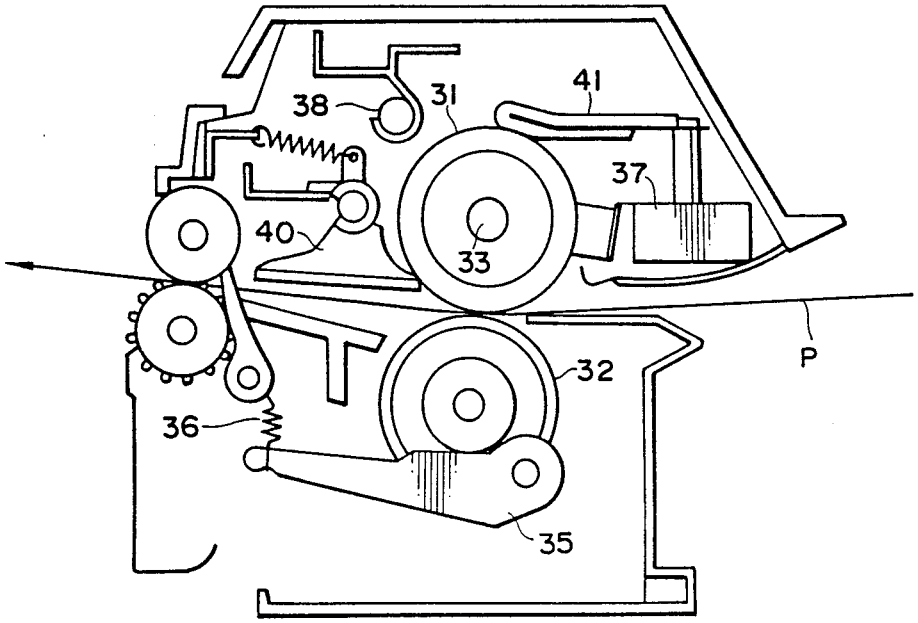
FIG. 4 is a schematic diagram of another example of a conventional image fixing unit.

According to the present invention, the previously mentioned heat-application roller 31 and the pressure-application roller 32 in the conventional image fixing unit as shown in FIG. 4 are respectively replaced by a heat-application roller 11 and a pressure-application roller 12 as shown in FIG. 2.

The above heat-application roller 11 is constructed in such a manner that an oil-resisting fluorinated silicone rubber layer 16 and a room temperature vulcanizing silicone rubber layer 17 are successively laminated around a core 15, with an inner heater 13 built-in.

The pressure-application roller 12 is coated by a Teflon-coated silicone rubber layer.

Figure 1:
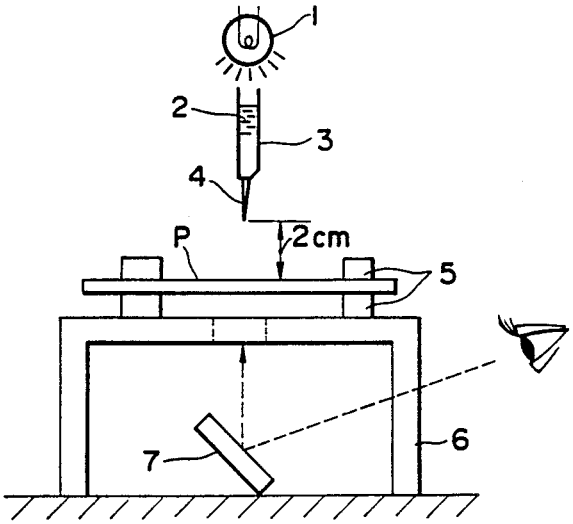
FIG. 1 is a schematic diagram of an apparatus for measuring the oil absorption coefficient a of the transfer sheet for use in the present invention.

In the present invention, special attention was paid to the relationship between the image flow phenomenon and the oil absorption property of the transfer sheets employed. Then, the oil absorption coefficient $\alpha$ of various kinds of transfer sheets was measured by using an apparatus as disclosed in Japanese Patent Publication No. 50-10649 as follows:

As shown in FIG. 1, reference numeral 1 indicates a light source, and as this light source, any ordinary lamp can be employed. Reference numeral 2 indicates a carrier liquid, and as this carrier liquid, a commercially available carrier liquid, such as Isopar G, Isopar H and Isopar L made by Exxon Co., can be employed. Reference numeral 3 indicates a 2-ml Luer's syringe for tuberculin, with a needle 4 of ⅓ attached thereto. Reference numeral 5 indicates a spacer, which also functions as a fastening member to fasten the transfer sheet P. Reference numeral 6 indicates a supporting table; and reference numeral 7 indicates a mirror.

The measurement conditions complied with the JIS P 8111 Japanese Industrial Standards) titled "Conditioning of Paper and Paperboard for Test". In particular, the temperature and the humidity were respectively set at 20 ±2° C. and 65 ±2%. Furthermore, the temperature of the carrier liquid was also adjusted to 20 ±2° C.

The oil absorption coefficient $\alpha$ of the transfer sheet was measured using the above-mentioned measuring apparatus, dropping one drop (0.004 cc) of the carrier liquid 2 onto the front side of the transfer sheet P by the syringe 3. The time required for the drop of the carrier liquid placed on the front side of the transfer sheet to spread to a diameter of 1 cm on the back side of the transfer sheet, which was observed by the mirror 7, was measured by a stopwatch with the accuracy in the order of 0.1 sec. The same measurement was repeated ten times by dropping the same carrier liquid at ten different spots on the same transfer sheet P to obtain an average value T(sec). Apart from this, the thickness H (cm) of the transfer sheet P was measured according to the JIS P 8118.

Thus oil absorption coefficient $\alpha$ is then obtained as follows:

$$\text{Oil absorption coefficient } \alpha = H/T \text{ (cm/sec)}$$

(Two significant digits are obtained.)

In order to demonstrate the advantages of the present invention, the image fixing tests were carried out using a liquid-type developer prepared by dispersing and diluting the previously mentioned thermal cross-linking toner disclosed in Japanese Laid-Open Patent Application 62-139426 in Isopar H with a dilution ratio of 50 g/l. In the previously, mentioned wet-type electrophotographic copying machine in which the heat-application roller 11 and the pressure-application roller 12 as shown in FIG. 2 were incorporated, a latent electrostatic image formed on the photoconductor was developed to a visible toner image by use of the above-prepared liquid-type developer, the visible toner image was transferred to various types of the transfer sheets, and then the transferred image was fixed by bringing a heat application means into direct contact with the transferred image while passing through the nip between the heat-application roller 11 and the pressure-application roller 12.

The image fixing performance of tested transfer sheets are shown in Table 1.

TABLE 1

| Transfer Sheet | Measuring Item | | | | | | |
|---|---|---|---|---|---|---|---|
| | Basic Weight ($g/m^2$) | Thickness (mm) | Bulk Density ($g/m^3$) | Oil Absorption Coefficient $\mu$ (cm/sec) (***) | Image Density | Image Flow | Image Fixing Performance Determined by Smear |
| Wet-type copying paper "RICOH TYP-1000" | 64.7 | 0.072 | 0.89 | $3.5 \times 10^{-2}$ | 1.50 | 4 | 4 |
| Ordinary copying paper "RICOH TYP-6700" | 68.6 | 0.083 | 0.82 | $3.8 \times 10^{-2}$ | 1.48 | 5 | 5 |
| Sheet for intermediates "RICOH TYPE TA" | 71.7 | 0.063 | 1.13 | $0.99 \times 10^{-2}$ | 1.03 | 2 | 3 |
| RICOH O.H.P. film | 149.3 | 0.113 | 1.32 | Unmeasurement due to no absorption | 0.31 | 2 | 2.5 |
| High-quality paper (Printing paper A according to JIS P 3102) <45 kg> supplied by NBS | 51.0 | 0.064 | 0.79 | $4.3 \times 10^{-2}$ | 1.45 | 4 | 4 |
| High-quality paper (Printing paper A according to JIS P 3102) <55 kg> supplied by NBS | 63.4 | 0.074 | 0.82 | $4.0 \times 10^{-2}$ | 1.45 | 4 | 4 |
| High-quality paper (Printing paper A according to JIS P 3102) <70 kg) supplied by NBS | 81.1 | 0.098 | 0.82 | $3.8 \times 10^{-2}$ | 1.49 | 5 | 4.5 |
| Medium-quality paper (Printing paper B) "Tokuyukizishi" (*) | 53.9 | 0.066 | 0.81 | $5.3 \times 10^{-2}$ | 1.43 | 5 | 5 |
| Medium-quality paper (Printing paper B) "Shinsetsu" (*) | 64.5 | 0.095 | 0.67 | $4.9 \times 10^{-2}$ | 1.46 | 4 | 4.5 |
| Woody paper "Tomazara" (Printing paper D) (**) | 47.5 | 0.077 | 0.61 | $6.4 \times 10^{-2}$ | 1.41 | 5 | 5 |
| Fuji Xerox Office Supply: Wet-type PPC copying paper | 68.8 | 0.071 | 0.96 | $0.93 \times 10^{-2}$ | 1.08 | 2 | 3 |
| Canon: Wet-type PPC copying paper | 65.2 | 0.076 | 0.85 | $0.86 \times 10^{-2}$ | 1.00 | 2 | 3 |
| Art paper (**) | 64.4 | 0.074 | 0.87 | $0.97 \times 10^{-2}$ | 0.92 | 2 | 4 |

(*) made by Daishowa Paper Manufacturing Co., Ltd.
(**) made by Oji Paper Co., Ltd.
(***) As the carrier liquid for the measurement of oil absorption coefficient $\alpha$ (cm/sec), "Isopar G" was employed at 200 ± 2° C.

In Table 1, the image flow was evaluated by visual inspection and the degree of the image flow is expressed by the following ranking scale:

1: Image flow is observed in all the obtained images and characters are illegible.
2: Image flow is slightly observed in the obtained images and the image density of the solid image areas is low.
3: Image flow is less, but the characters in the solid image areas spread.
4: Image flow is hardly observed and the characters in the solid image areas slightly spread.
5. Image flow is not observed at all and the characters in the solid image areas are clear.

The image fixing performance determined by the presence of smear, also given in Table 1, was evaluated by rubbing the obtained images and the degree of the image fixing performance is expressed by the following ranking scale:

1: Obtained images are rubbed off very easily.
2: Obtained images are readily smeared by slight rubbing.
3: Obtained images are slightly smeared by normal rubbing.
4: Obtained images are not smeared at all by normal rubbing.
5: Obtained images are not smeared at all even by strong rubbing.

The test results shown in Table 1 indicate that the image fixing performance as determined by the presence of the smear and the image flow is excellent when the thermal cross-linking toner is employed in combination with the transfer sheet having an oil absorption coefficient $\alpha$ of $1.0 \times 10^2$ cm/sec or more.

What is claimed is:

1. An image fixing method for use in a wet-type electrophotographic copying machine comprising the steps of:

developing a latent electrostatic image formed on an electrophotographic photoconductor element to a visible toner image by use of a developer comprising a thermal cross-linking toner and a carrier liquid, transferring said visible toner image to a transfer sheet having an oil absorption coefficient $\alpha$ of $1.0 \times 10^{-2}$ cm/sec or more, which is determined by dividing the thickness of said transfer sheet by the time required for a drop of said carrier liquid placed on the front side of said transfer sheet to spread to a diameter of 1 cm on the back side of said transfer sheet, to form a transferred image on said transfer sheet, and fixing said transferred image to said transfer sheet by bringing a heat application means into direct contact with said transferred image.

2. The image fixing method for use in a wet-type electrophotographic copying machine as claimed in claim 1, wherein said thermal cross-linking toner comprises a resin and a pigment.

3. The image fixing method for use in a wet-type electrophotographic copying machine as claimed in claim 2, wherein said thermal cross-linking toner further comprises a polarity controlling agent in an effective amount.

4. The image fixing method for use in a wet-type electrophotographic copying machine as claimed in claim 2, wherein said resin in said thermal cross-linking toner is selected from the group consisting of:

(1) a resin comprising 50 parts by weight of styrene, 40 parts by weight of methyl methacrylate and 10 parts by weight of divinylbenzene in weight ratio;

(2) a resin comprising 60 parts by weight of styrene, 35 parts by weight of methyl acrylate and 5 parts by weight of divinylbenzene in weight ratio; and (3) a resin comprising 75 parts by weight of styrene, 20 parts by weight of n-butyl acrylate and 5 parts by weight of divinylbenzene in weight ratio.

5. The image fixing method for use in a wet-type electrophotographic copying machine as claimed in claim 4, wherein said resin in said thermal cross-linking toner is a resin comprising 50 parts by weight of styrene, 40 parts by weight of methyl methacrylate and 10 parts by weight of divinylbenzene in weight ratio.

6. The image fixing method for use in a wet-type electrophotographic copying machine as claimed in claim 4, wherein said resin in said thermal cross-linking toner is a resin comprising 60 parts by weight of styrene, 35 parts by weight of methyl acrylate and 5 parts by weight of divinylbenzene in weight ratio.

7. The image fixing method for use in a wet-type electrophotographic copying machine as claimed in claim 4, wherein said resin in said thermal cross-linking toner is a resin comprising 75 parts by weight of styrene, 20 parts by weight of n-butyl acrylate and 5 parts by weight of divinylbenzene in weight ratio.

8. The image fixing method for use in a wet-type electrophotographic copying machine as claimed in claim 2, wherein said pigment in said thermal cross-linking toner is carbon black.

* * * * *

UNITED STATES PATENT AND TRADEMARK OFFICE

CERTIFICATE OF CORRECTION

PATENT NO. : 4,948,691

DATED : AUGUST 14, 1990

INVENTOR(S) : TSUNEO KUROTORI ET AL

It is certified that error appears in the above-identified patent and that said Letters Patent is hereby corrected as shown below:

Column 2, line 59, delete "a", insert --α--.

Column 3, line 5, delete "a", insert --α--.

Column 4, line 19, before "JIS P", insert --(--;
line 53, delete "g/l", insert --g/ℓ--;
line 53, after "previously", delete ",".

Col. 5, line 22, delete "<70 kg", insert --<70 kg> --.

Column 6, line 45, delete "$1.0X10^2$, insert --$1.0X10^{-2}$--.

Signed and Sealed this

Thirteenth Day of July, 1993

*Attest:*

Michael K. Kirk

MICHAEL K. KIRK

*Attesting Officer*

*Acting Commissioner of Patents and Trademarks*